US006958574B1

(12) United States Patent
Chung et al.

(10) Patent No.: US 6,958,574 B1
(45) Date of Patent: Oct. 25, 2005

(54) IMAGE DISPLAY DEVICE

(75) Inventors: Chong-In Chung, Suwon (KR); Chang-Seok Rho, Suwon (KR); Jong-Hwan Park, Suwon (JP); Tae-Il Yoon, Seoul (KR); Chang-Sub Lee, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 698 days.

(21) Appl. No.: 09/721,769

(22) Filed: Nov. 27, 2000

(30) Foreign Application Priority Data

Nov. 26, 1999 (KR) ..... 1999/53178

(51) Int. Cl.[7] ..... H01J 29/88

(52) U.S. Cl. ..... 313/479; 313/489; 313/112; 313/478

(58) Field of Search ..... 313/479, 480, 313/493, 112, 634, 635, 110, 496, 477 R, 313/489, 478

(56) References Cited

U.S. PATENT DOCUMENTS 4,563,612 A 1/1986 Deal et al.
4,739,412 A 4/1988 Lee
4,804,883 A 2/1989 Müller et al.
4,987,338 A * 1/1991 Itou et al. ..... 313/478
5,025,490 A * 6/1991 Tamura ..... 313/479
5,475,282 A * 12/1995 Liao ..... 313/440
5,519,282 A 5/1996 Takizawa et al.
5,550,429 A 8/1996 Hayama et al.
5,605,595 A * 2/1997 Beeteson et al. ..... 156/295
5,789,854 A 8/1998 Takizawa et al.
5,874,801 A * 2/1999 Kobayashi et al. ..... 313/478
5,959,399 A 9/1999 Arimoto et al.
5,998,919 A 12/1999 Yoo et al.
6,087,769 A 7/2000 Aben et al.
6,104,530 A 8/2000 Okamura et al.
6,104,534 A 8/2000 Ohta et al.
6,111,698 A 8/2000 Woodard et al.
6,129,980 A 10/2000 Tsukada et al.
6,132,881 A 10/2000 Hartig et al.
6,133,686 A * 10/2000 Inoue et al. ..... 313/477 R
6,333,596 B1 * 12/2001 Shim ..... 313/479
6,448,706 B1 * 9/2002 Kawamura et al. ..... 313/477 R
6,469,440 B1 * 10/2002 Saito et al. ..... 313/582
6,579,919 B2 * 6/2003 Konings et al. ..... 523/118

* cited by examiner

*Primary Examiner*—Edward J. Glick
*Assistant Examiner*—Elizabeth Keaney
(74) *Attorney, Agent, or Firm*—Robert E. Bushnell, Esq.

(57) ABSTRACT

An image display device for providing antireflection and electromagnetic shielding effects is disclosed. The device has a faceplate, a coating panel made of glass, a plurality of coating layers laminated on one surface of the coating panel for performing antireflection and electromagnetic shielding functions, and an adhering layer for adhering the coating panel to the faceplate. The adhering layer may be an ultraviolet curable resin.

27 Claims, 2 Drawing Sheets

IMAGE DISPLAY DEVICE

CLAIM OF PRIORITY

This application makes reference to, incorporates the same herein, and claims all benefits accruing under 35 U.S.C. §119 from my application PICTURE DISPLAY DEVICE filed with the Korean Industrial Property Office on 26 Nov. 2000 and there duly assigned Serial No. 1999/53178.

BACKGROUND OF THE INVENTION

1. Field of the Invention

The present invention relates to an image display device, and more particularly to an image display device having coating layers and a coating panel on the faceplate thereof, for providing antireflection and electromagnetic shielding effects.

2. Description of the Related Art

In well-known image display devices including cathode ray tubes, a faceplate of the device is generally surface-treated to prevent the reflection of external light to the user and to enhance electromagnetic shielding effects, thereby providing comfort for users as well as enhancing the overall quality of the device.

U.S. Pat. No. 4,563,612, to Deal et al., entitled CATHODE-RAY TUBE HAVING ANTISTATIC SILICATE GLARE-REDUCING COATING, describes surface treatments for a cathode-ray tube. Surface treatment techniques include a spray coating method using spray robots, and a spin coating method. Another surface treatment involves (1) depositing layers of various resin films such as polyethylene terephthalate (PET) by a sputtering method, and then (2) adhering the films to the outer surface of the faceplate.

However, the conventional surface treatment techniques have a number of drawbacks. First, with the spray coating and spin coating methods there is a high possibility of pores forming in the 8 coating layer at curing temperatures suitable for cathode ray tubes (CRTs). The pores may change the surface resistance of the coating layer and they may also result in spots on the surface of the coating layer.

The film adhering methods result in poor hardness of the depositing layer, that is, less than 4H in a pencil hardness scale. Further, PET resin also has poor mechanical strength and thus may be easily damaged during storing, transporting, and use.

U.S. Pat. No. 4,739,412, to Lee, entitled CATHODE RAY TUBE IMPLOSION PROTECTION SYSTEM, describes a system with an implosion protection panel bonded to the faceplate of a CRT tube and cured by exposure to ultraviolet radiation. This system is usable with color CRTs which employ a flat, tensioned shadow mask and a flat faceplate. This system requires an adhesion system allowing the implosion protection panel to separate from the faceplate upon impact. This system does not address antireflection and electromagnetic shielding effects, however.

SUMMARY OF THE INVENTION

It is therefore an object of the present invention to provide an improved image display device.

It is therefore an object of the present invention to provide an image display device with antireflection as well as electromagnetic shielding properties.

It is another object of the present invention to provide an image display device capable of enhancing user comfort.

Yet another object of the invention is to provide an image display device having a surface with high hardness.

Still another object of the invention is to provide an image display device having a surface without pores or spots.

A further object of the invention is to provide an image display device of high overall quality.

A yet further object of the invention is to provide an image display device of low manufacturing cost.

To achieve these objects, as embodied and broadly described herein, an image display device according to the present invention includes a faceplate, a coating panel made of glass, a plurality of coating layers laminated on one surface of the coating panel for performing antireflection and electromagnetic shielding functions, and an adhering layer for adhering the coating panel to the faceplate.

The image display device is preferably a CRT which may be either have a curved or a flat faceplate. The adhering layer may be an ultraviolet curable resin.

According to an aspect of the present invention, a method of manufacturing an image display device is provided, including the steps of: forming a plurality of coating layers on a coating panel of glass; providing an adhesive material on either the coating panel or a faceplate on which a phosphor layer is formed; adhering the coating panel and the faceplate; and curing the adhesive material.

Both the foregoing general description and the following Detailed Description are exemplary and are intended to provide further explanation of the invention as claimed.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

The present invention will be described in detail with reference to the accompanying drawings.

Figure 1:
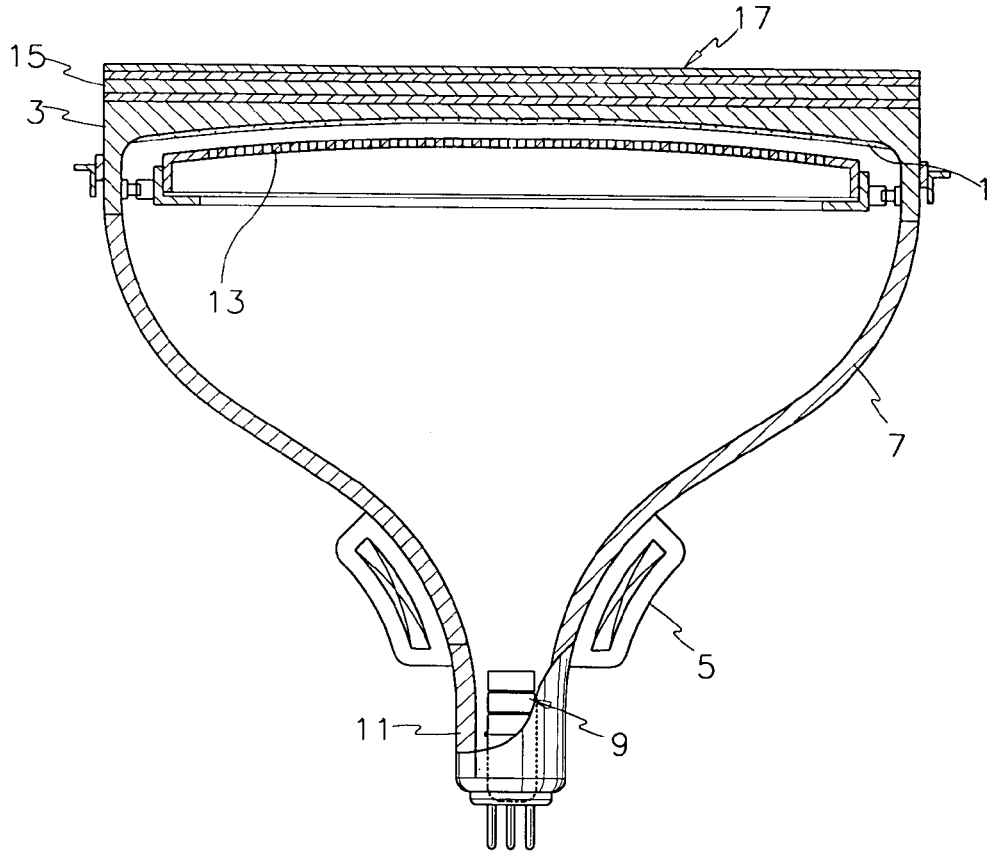
FIG. 1 shows a cross section of a cathode ray tube according to a first embodiment of the present invention.

Referring to FIG. 1, a first embodiment of an image display device of the present invention is illustrated in a cathode ray tube (CRT). The cathode ray tube is formed with a vacuum envelope having a faceplate (or panel) 3, a funnel 7 formed contiguous to the faceplate 3, and a cylindrical neck 11 formed contiguous to the funnel 7. A deflection yoke 5 is mounted on the outer side of the funnel 7 near the neck 11, and an electron gun 9 is mounted inside the neck 11. At the inner surface of the faceplate 3, a phosphor screen 1 is formed and a shadow mask 13 is further attached.

In the present invention, the surface treatment of the faceplate 3 has antireflection and electromagnetic shielding functions. In the first embodiment of the present invention, a coating panel 15 is provided which is made of glass. A plurality of coating layers 17 are laminated on a surface of the coating panel 15 which is adhered to the faceplate 3, for performing antireflection and electromagnetic shielding functions.

Figure 2:
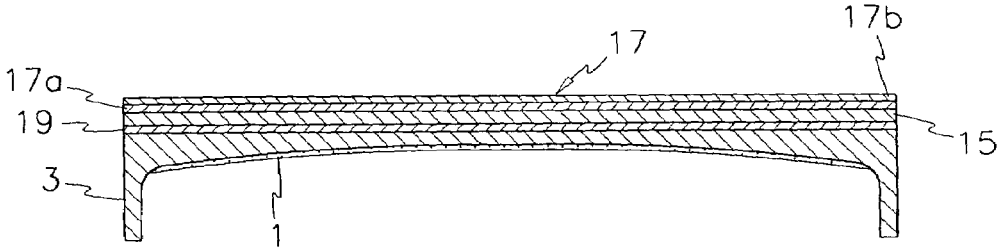
FIG. 2 is a partial cross-sectional view of a faceplate and coating panel according to the first embodiment of the present invention.

The coating layers 17 are formed by depositing at least two thin layers with different refractive indices. In the first embodiment, as shown in FIG. 2, a high refractive layer 17*a* and a low refractive layer 17*b* are deposited. Here, the term "high refractive layer" is taken to mean that this layer has a higher refractive index than the "low refractive layer". One high refractive layer 17*a* and one low refractive layer 17*b* are shown in FIG. 1. Additional layers may also be used, in which case the high refractive layers and low refractive layers are alternately formed.

The material of the high refractive layer 17*a* is preferably selected from metals such as Ag, Ni, Co and Cr, or from metal oxides and metal nitrides such as $Si_3N_4$, TiN, NbO, indium tin oxide (ITO), $TiO_2$ and $SiO_2$. The high refractive layer 17*a* has a refractive index ranging from 1.8 to 2.5. The material of the low refractive layer 17*b* is preferably formed from silica having a refractive index below 1.6.

The layers 17*a* and 17*b* are preferably formed by a sputtering method using physical vapor 8' deposition (PVD) or a pyrolysis method using chemical vapor deposition (CVD). The layer 17*a* is typically deposited with a thickness of 10–70 nm, while the layer 17*b* is deposited having a thickness of 50–130 nm.

After the coating layers 17*a* and 17*b* are formed on the coating panel 15, the coating panel 15 is adhered to the faceplate 3 with an ultraviolet (UV) curable resin 19. The adhering process using UV curable resin 19 is as follows.

First, the UV curable resin 19 is applied to either the coating panel 15 or the faceplate 3. The coating panel 15 and the faceplate 3 are brought into contact with each other, and then ultraviolet light is irradiated to cure the UV resin 19. The coating panel 15 and the faceplate 3 are thenceforth adhered to each other.

The UV curable resin 19 preferably has a transmittance in the visible light region ranging from 50% to 95%. The transmittance of the UV curable resin may be selected depending on the transmittance of the coating layers 17, the coating panel 15 and the faceplate 3. The ultraviolet curable resin 19 preferably has a refractive index ranging from 1.50 to 1.60 for antireflection reasons. Further, the UV curable resin 19 may have dispersed therein at least one dye such as xanthene, triarylmethane, and phenazine. The dye dispersed in the UV curable resin may absorb the ambient light of wavelengths other than light emitted by the phosphors, so that the imaging quality of the CRT can be improved.

Experimental results for the present invention are shown in Table 1 below. CRTs with a surface treatment according to the present invention and CRTs with conventional coatings such as spray coating and film attaching are compared in view of test items such as surface resistance and hardness.

TABLE 1

| | Surface resistance | Hardness in pencil hardness |
|---|---|---|
| Present invention | <0.7 kΩ/m$^2$ | >9H |
| Spray coating | >5 kΩ/m$^2$ | <7H |
| Film attaching | <1 kΩ/m$^2$ | <4H |

As shown in Table 1, the surface treatment according to the present invention enhances the hardness of the coating layers, so that it can prevent the coating layers from being damaged due to external impacts. Further, it can reduce the surface resistance thereby improving the electromagnetic shielding.

Further, the surface treatment according to the present invention effectively prevents external light from reflecting to the user. Table 2 shows the experimental result for antireflection.

TABLE 2

| | Iluminance of the light reflected from the CRT (ft L) | Improvement of contrast (%) |
|---|---|---|
| Present invention with a coating panel as well as coating layers | 1.5 | 50 |
| Conventional type with coating panel but without coating layers | 3.1 | — |

The experimental conditions are such that the external illuminance is set to 400 Lux. As shown in Table 2, the light reflected from the CRT according to the present invention has been reduced and contrast is improved to 50%, to provide comfortable use.

Figure 3:
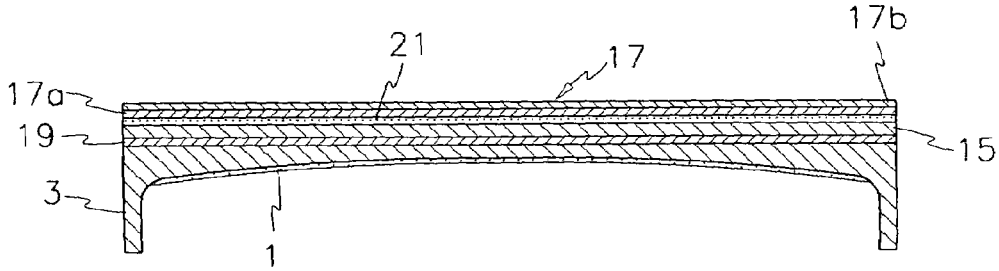
FIG. 3 is a partial cross-sectional view of a faceplate and coating panel according to a second embodiment of the present invention.

Referring now to FIG. 3, an image display device according to a second embodiment is also implemented in a cathode ray tube (CRT). A CRT is arranged in the same way as in the first embodiment. The surface treatment of the second preferred embodiment includes a buffer layer 21 disposed between a coating panel 15 and the high refractive layer 17*a* of the coating layers 17.

When the coating panel 15 is made of glass, sodium of the coating panel 15 may diffuse into the coating layers during the sputtering or pyrolysis process. This diffusion may destroy the molecular arrangement of the coating panel 15, as well as change the refractive index of the coating layers, resulting in degradation of the function of antireflection. The buffer layer 21 is made of a material which prevents sodium of the coating panel 15 from diffusing into the coating layers. The material of the buffer layer 21 is preferably silica.

Figure 4:
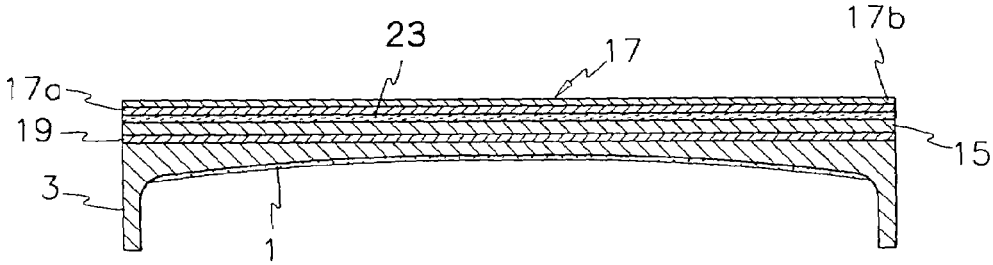
FIGS. 4 and 5 are partial cross-sectional views of a faceplate and coating panel according to a third embodiment of the present invention.
Figure 5:
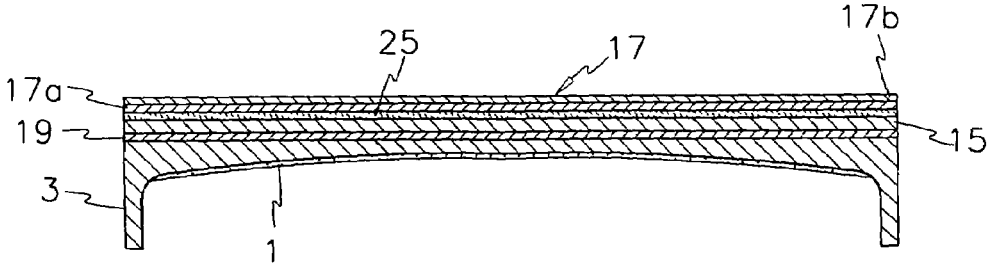

Referring now to FIGS. 4–5, an image display device according to a third embodiment is also implemented in a cathode ray tube (CRT). A CRT is arranged in the same way as in the first preferred embodiment. The surface treatment of the third embodiment provides a transmittance adjusting layer disposed between the coating panel 15 and the coating layers 17 for adjusting transmittance of the faceplate portion in order to enhance the contrast.

The transmittance-adjusting layer may be a metal compound or glass which has a different refractive index than the coating panel. FIG. 4 illustrates that the transmittance adjusting layer comprises at least one layer 23 of a metal compound which may be selected from a group consisting of Ni, Co, Cr, and TiN. The transmittance-adjusting layer 23 of the metal compound may change the transmittance range in the visible region by from 10% to 60%.

FIG. 5 illustrates that the transmittance adjusting layer is a glass plate 25 which has a predetermined transmittance in the visible region in the range of 40% to 90%. When a glass plate 25 having a transmittance of 55% is used as a transmittance layer, it is expected that the contrast may be enhanced by 15%. Therefore, the present invention employs a transmittance-adjusting layer to enhance the overall contrast.

It will be apparent to those skilled in the art that various modifications and variations can be made to the device of the present invention without departing from the spirit and scope of the invention. The present invention covers the modifications and variations of this invention provided they come within the scope of the appended claims and their equivalents.

What is claimed is:

1. An image display device, comprising:

a faceplate having an outer surface;

an adhering layer on the outer surface of the faceplate, said adhering layer consisting essentially of a layer formed from an ultraviolet curable resin, said adhering layer having a refractive index in the range of 1.50 to 1.60 and a transmittance in the visible light region ranging from 50% to 95%;

a coating panel made of glass, one surface of the coating panel attached to the faceplate by the adhering layer;

a transmittance adjusting layer being in contact with the other surface of the coating panel for absorbing light in the visible region, said transmittance adjusting layer comprising a glass plate; and at least two coating layers comprising a first coating layer and a second coating layer, said first coating layer formed on the transmittance adjusting layer, said at least two coating layers providing antireflection and electromagnetic shielding, said first coating layer having a higher refractive index than said second coating layer.

2. The device of claim 1, further comprising:

a third coating layer formed on the second coating layer; and a fourth coating layer formed on the third coating layer, wherein said third coating layer has a higher refractive index than said fourth coating layer.

3. The device of claim 1, wherein said at least two coating layers further comprises:

a plurality of high refractive layers and low refractive layers alternately formed on the coating panel.

4. The device of claim 1, said first coating layer having a refractive index in the range of 1.8 to 2.5.

5. The device of claim 1, said second coating layer having a refractive index of less than 1.6.

6. The device of claim 1, said first coating layer being made of a metal.

7. The device of claim 1, said first coating layer being made of a metal selected from the group consisting of Ag, Ni, Co and Cr.

8. The device of claim 1, said first coating layer being made of a metal oxide.

9. The device of claim 8, said first coating layer being made of a material selected from the group consisting of $Si_3N_4$, TiN, NbO, indium tin oxide, $TiO_2$ and $SiO_2$.

10. The device of claim 1, said first coating layer being of a thickness in the range of 10 to 70 nm.

11. The device of claim 1, said second coating layer being of a thickness in the range of 50 to 130 nm.

12. The device of claim 1, said first coating layer being formed by one selected from the group consisting of a method of sputtering using physical vapor deposition, and a chemical vapor deposition method.

13. The device of claim 1, said first coating layer and said second coating layer being formed on said coating panel before the coating panel is adhered to the faceplate.

14. The device of claim 1, said ultraviolet curable resin further comprising a dye.

15. The device of claim 14, said dye being selected from xanthene, triarylmethane and phenazine.

16. The device of claim 1, further comprising:

a phosphor layer formed on the inner surface of the faceplate;

a funnel connected to the faceplate;

a deflection yoke mounted on an outer periphery of the funnel;

a neck connected to the funnel; and an electron gun mounted in the neck.

17. The device of claim 1, said faceplate having a curved inner surface and a flat outer surface.

18. The device of claim 1, wherein said first coating layer has a refractive index in the range of 1.8 to 2.5, and said low refractive index layer has a refractive index of less than 1.6.

19. An image display device, comprising:

a faceplate having an outer surface;

an adhering layer on the outer surface of the faceplate, said adhering layer consisting essentially of a layer formed from an ultraviolet curable resin, said adhering layer having a refractive index in the range of 1.50 to 1.60 and a transmittance in the visible light region ranging from 50% to 95%;

a coating panel made of glass, one surface of the coating panel attached to the faceplate by the adhering layer;

a transmittance adjusting layer being in contact with the other surface of the coating panel for absorbing light in the visible region, said transmittance adjusting layer comprising a glass plate; and an antireflection layer comprising a first layer formed on said transmittance adjusting layer and a second layer formed on said first layer, said second layer having a refractive index less than that of said first layer.

20. The device of claim 19, said transmittance adjusting layer reducing the transmittance of the image display device by in the range of 10% to 60%.

21. The device of claim 19, wherein said adhering layer comprises an ultraviolet curable resin, said first layer comprises a material selected from Ag, Ni, Co, Cr, $Si_3N_4$, TiN, NbO, indium tin oxide, $TiO_2$ and $SiO_2$, and said second layer comprises $SiO_2$.

22. The device of claim 19, wherein said first layer has a refractive index in the range of 1.8 to 2.5, and said second layer has a refractive index of less than 1.6.

23. An image display device, comprising:

a faceplate having an outer surface;

an adhering layer on the outer surface of the faceplate, said adhering layer consisting essentially of a layer formed from an ultraviolet curable resin, said adhering layer having a refractive index in the range of 1.50 to 1.60 and a transmittance in the visible light region ranging from 50% to 95%;

a coating panel made of glass, one surface of the coating panel attached to the faceplate by the adhering layer;

a glass plate being in contact with the other surface of the coating panel for absorbing light in the visible region; and an antireflection layer comprising a first layer formed on said glass plate and a second layer formed on said first layer, said second layer having a refractive index less than that of said first layer.

24. The device of claim 23, said glass plate having a transmittance in the visible region in the range of 40 to 90%.

25. The device of claim 24, said glass plate having a transmittance of approximately 55%.

26. The device of claim 23, wherein said adhering layer comprises an ultraviolet curable resin, said first layer comprises a material selected from Ag, Ni, Co, Cr, $Si_3N_4$, TiN, NbO, indium tin oxide, $TiO_2$ and $SiO_2$, and said second layer comprises $SiO_2$.

27. The device of claim 23, wherein said first layer has a refractive index in the range of 1.8 to 2.5, and said second layer has a refractive index of less than 1.6.

* * * * *